US006196193B1

(12) United States Patent
Heinz et al.

(10) Patent No.: US 6,196,193 B1
(45) Date of Patent: Mar. 6, 2001

(54) FUEL INJECTION DEVICE

(75) Inventors: Rudolf Heinz, Renningen; Roger Potschin, Brackenheim; Klaus-Peter Schmoll, Lehrensteinsfeld; Friedrich Boecking, Stuttgart, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/254,632

(22) PCT Filed: Mar. 10, 1998

(86) PCT No.: PCT/DE98/00700

§ 371 Date: May 28, 1999

§ 102(e) Date: May 28, 1999

(87) PCT Pub. No.: WO99/02849

PCT Pub. Date: Jan. 21, 1999

(30) Foreign Application Priority Data

Jul. 11, 1997 (DE) ..... 197 29 844

(51) Int. Cl.[7] ..... F02M 41/00; B05B 9/00

(52) U.S. Cl. ..... 123/459; 239/124

(58) Field of Search ..... 123/447, 459, 123/506, 456; 239/124, 533.8, 533.9, 585.1

(56) References Cited

U.S. PATENT DOCUMENTS 4,465,231 * 8/1984 Sharp ..... 239/5
5,255,845 * 10/1993 Brunel ..... 239/90
5,282,574 * 2/1994 Koch ..... 239/90
5,779,149 * 7/1998 Hayes, Jr. ..... 239/124

FOREIGN PATENT DOCUMENTS 44 06 901 * 9/1995 (DE) .
44 34 892 * 4/1996 (DE) .
29708 369 * 7/1997 (DE) .
0615 064 * 9/1994 (EP) .

* cited by examiner

*Primary Examiner*—Henry C. Yuen
*Assistant Examiner*—Mahmoud M. Gimie
(74) *Attorney, Agent, or Firm*—Ronald E. Greigg; Edwin E. Greigg

(57) ABSTRACT

A fuel device including a high-pressure fuel source from which fuel is supplied to fuel injection valves. The fuel injection valves are controlled with the aid of a valve that is driven by a piezoelectric or magnetostrictive drive mechanism. With the aid of this drive mechanism, a 3-way valve having a closing body can be adjusted in an intermediary position in which a control chamber, by way of which a hydraulic force can be exerted in the closing direction on a valve closing member of the injection valve, can simultaneously be connected to a high-pressure fuel source and a relief chamber in order to adjust a control pressure that lies between the high pressure of the high-pressure source and a relief pressure. In this manner, a partial opening of the injection valve member of the injection valve can be adjusted in order to introduce a reduced injection quantity into the combustion chamber of the internal combustion engine.

4 Claims, 3 Drawing Sheets

FUEL INJECTION DEVICE

PRIOR ART

The invention is based on a fuel injection device for a vehicle. In a fuel injection device of this kind, which has been disclosed by DE 44 06 901, a 3-way valve is used, which allows the control chamber to communicate either exclusively with the high-pressure fuel source or exclusively with a fuel return container. The actuation of the valve member of this 3-way valve is executed with the aid of an electromagnet. With this known embodiment, the injection valve member is brought either into a completely open position or into a completely closed position, depending on the triggering of the 3-way valve.

ADVANTAGES OF THE INVENTION

The fuel injection device according to the invention has an advantage over the prior art that the valve body of the valve member can be brought into an intermediary position so that through the corresponding control of the simultaneously existing connection to the high-pressure fuel source on the one hand and to the relief chamber on the other, the control chamber has a lower or higher pressure than if the control chamber were to be connected exclusively to one or the other of the pressure levels. Consequently, the injection valve member can also assume an intermediary position corresponding to a partial opening, which permits the valve member to produce a reduced injection rate of fuel into the combustion chamber in this position. A 3-way valve of the type defined can thus be used to advantageously produce a pre-injection that typically requires only a very small injection quantity. Through the partial excitation of the piezoelectric element or of the magnetostrictive element, the valve member executes a partial path and stays in a position between the two valve seats. Then, the valve member can be brought back into a position pushing against the control chamber in order to interrupt the fuel injection between a pre-injection and a main injection in order to be finally brought into a position that completely shuts off the inflow conduit, which leads to the discharge of the control chamber and produces the main injection that follows the pre-injection.

Accordingly, the tappet that actuates the valve body of the valve member is advantageously connected to this valve body. In order to adjust the relief dynamics, a throttle is advantageously disposed in the outflow conduit.

BRIEF DESCRIPTION OF THE DRAWINGS

An exemplary embodiment of the invention is shown in the drawings and will be explained in more detail in the description below.

DETAILED DESCRIPTION

Figure 1:
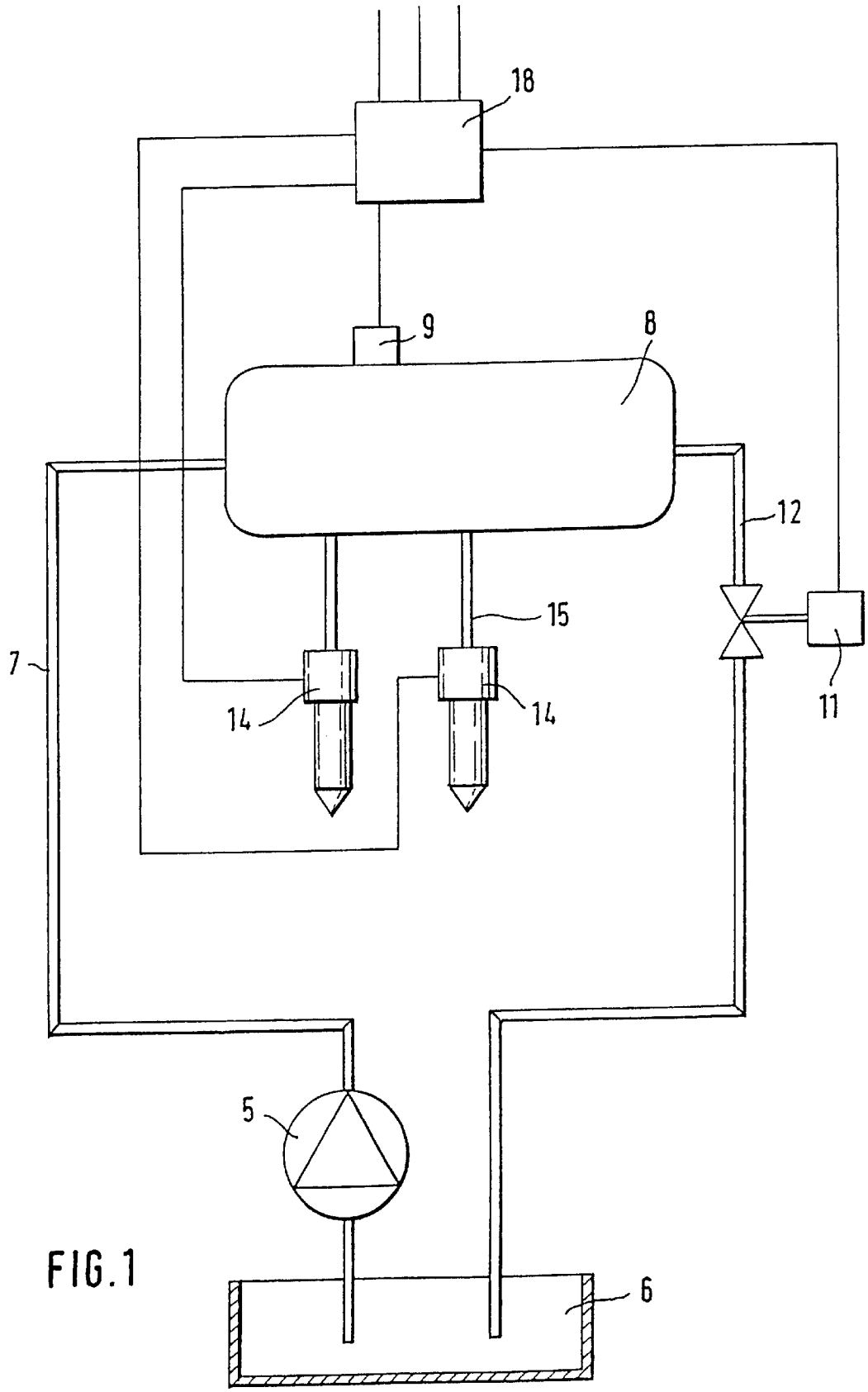
FIG. 1 is a schematic representation of the fuel injection device.

The invention is based on a fuel injection device that has a high-pressure fuel pump 5, which obtains fuel from a fuel tank 6, if need be with the interposition of a pre-feed pump, and supplies the fuel at high pressure by way of a pressure line 7 to a high-pressure fuel reservoir 8. These parts are referred to as the high-pressure fuel source. In order to control the pressure in the high-pressure fuel reservoir 8, a relief line 12 is provided, which contains a pressure control valve 11 and leads from the high-pressure fuel reservoir back to the fuel tank 6. By way of fuel lines 15, the high-pressure fuel reservoir 8 supplies each fuel injection valve 14 with fuel, which has been brought to fuel injection pressure. These fuel injection valves are electrically controlled by a control device 18, which controls the opening of the fuel injection valves 14 in accordance with operating parameters of the internal combustion engine and thus determines the onset and duration of fuel injection. This control device also simultaneously controls the pressure control valve, wherein the pressure in the high-pressure fuel reservoir is detected as a parameter by means of a pressure sensor 9 and is supplied to the control device.

Figure 2:
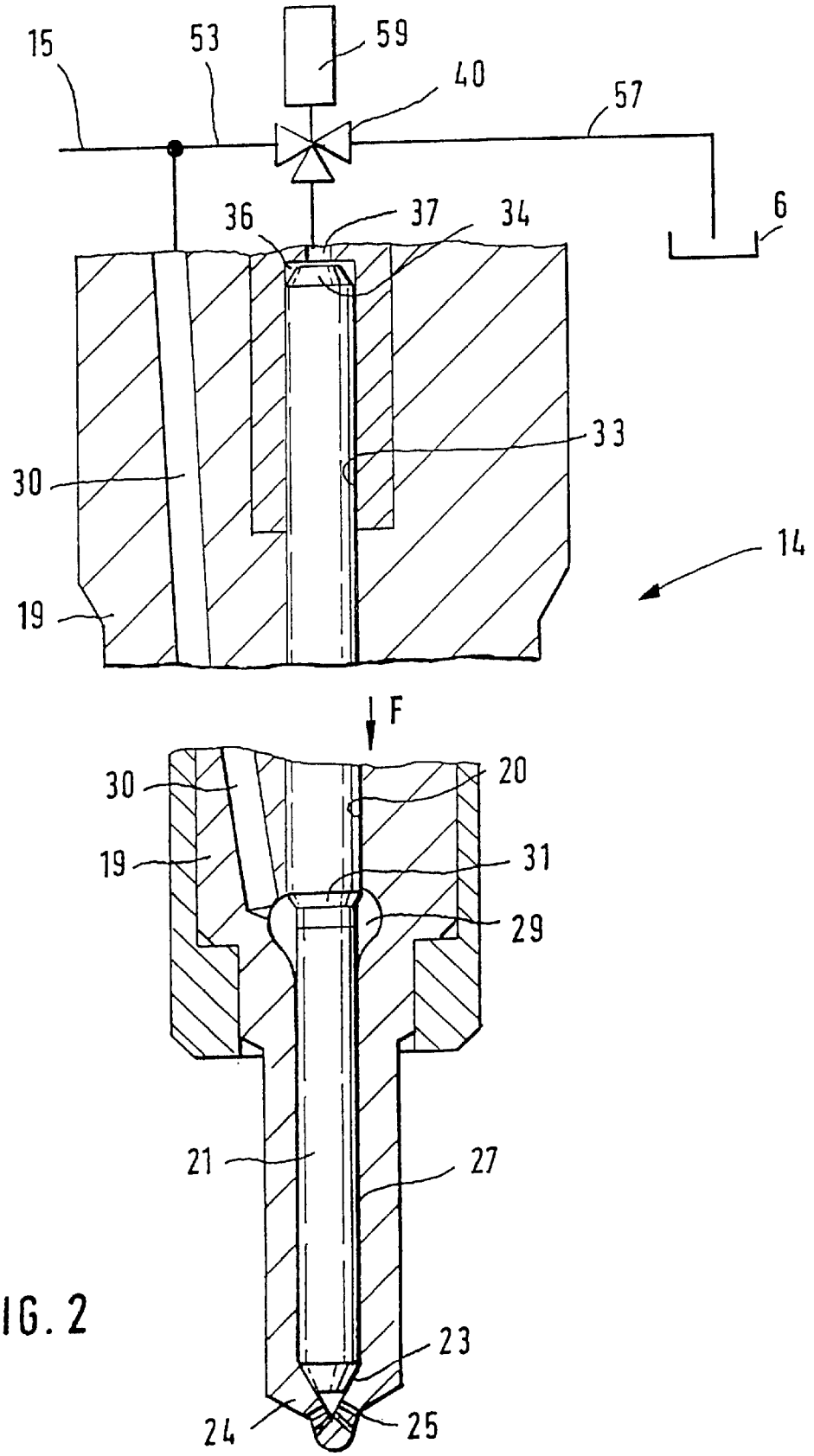
FIG. 2 is a sectional view of a fuel injection valve of the fuel injection device.
Figure 3:
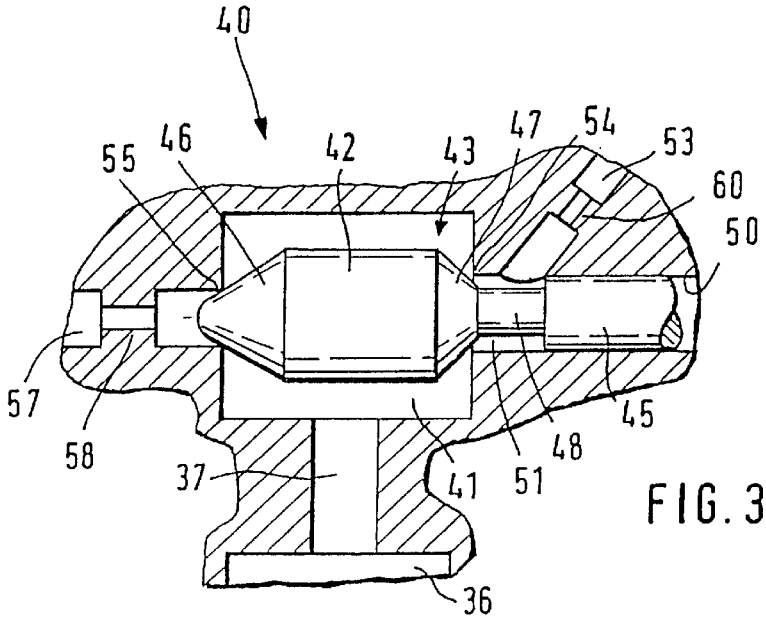
FIG. 3 shows the valve member that controls the fuel injection device.

FIG. 2 shows parts of a fuel injection valve 14 in a sectional view. This valve has a housing 19 in which a needle-like injection valve member 21 is guided in a longitudinal bore 20. On its one end, this injection valve member is provided with a conical sealing face 23, which cooperates with a seat on the tip 24 of the valve housing that protrudes into the combustion chamber of the internal combustion engine, and injection openings 25 lead from this seat and connect the interior of the fuel injection valve, in this instance the annular chamber 27 which encompasses the injection valve member 21 and is filled with fuel at injection pressure, to the combustion chamber in order to thus execute an injection when the injection valve member has lifted up from its seat. The annular chamber 27 is connected to a pressure chamber 29 that continuously communicates with a pressure line 30, which is connected to the fuel line 15 of the respective fuel injection valve. The fuel pressure thus supplied to the high-pressure fuel reservoir 8 also prevails in the pressure chamber 29 and acts on a pressure shoulder 31 there by way of which the fuel injection valve member can be lifted up in a known manner from its valve seat under suitable conditions. On the other end of the injection valve member, the valve member is guided in a cylinder bore 33 and encloses a control chamber 36 there with its end face 34. The closed position of the injection valve member is controlled by means of the pressure in the control chamber 36 and also by means of a compression spring that is only depicted symbolically here by means of an arrow F acting in the closed direction. Whereas the spring F that acts in the closing force does not change in its characteristic curve, the opening and closing motion of the injection valve member is triggered with the aid of the pressure in the control chamber 36. To that end, the control chamber 36 is connected by way of a conduit 37 to a valve 40 that is embodied as a 3-way valve. This valve is shown in more detail in FIG. 3. In this instance, the conduit 37 feeds from the control chamber (36) into a valve chamber 41 in which a closing body 42 of the valve member 43 of the valve 40 is movably disposed. To that end, the valve member 43 has a tappet 45 that is connected to the closing body 42. A first sealing face 46 is disposed on the one end face of the closing body and the second sealing face 47 is disposed on its other end face. The second sealing face transitions into a connecting piece 48 to the tappet, which has a smaller diameter than the rest of the tappet 45, which is guided in a guide bore 50. An annular chamber 51, which is fed by an inflow conduit 53 is formed between the guide bore and the connecting part 48 of the tappet 45. The annular chamber 51 constitutes a through flow conduit between the inflow conduit and the valve chamber 41. At the discharge of the guide bore 50 into the valve chamber 41, a valve seat 54 is embodied, which as a second valve seat, cooperates with the second sealing face 47. Coaxial to this and coaxial to the valve member 43 or to the closing member 42, on the opposite end of the valve chamber 41, a first valve seat 55 is embodied, which cooperates with the first sealing face 46. Starting from the valve seat 55, an outflow conduit 57 leads from the valve chamber 41. This is likewise represented in FIG. 2 and leads back to the fuel tank 6 or to an otherwise embodied relief chamber. A throttle 58 is provided in the outflow conduit, which determines the outflow cross section when the valve body is lifted up from the first valve seat 55. The inflow conduit 53, which can also be seen in FIG. 2, is connected to the fuel line 15 and can consequently supply fuel from the high-pressure fuel reservoir to the control chamber 36 by way of the valve chamber 41 when the valve member 43 is lifted up from the second valve seat 54.

The first and the second sealing face 46 and 47, respectively, are embodied as conical in the current instance. The actuation of the valve member 43 is carried out via the tappet 45 by a drive mechanism 59, not shown in detail, which is embodied as a piezoelectric device, e.g. as a so-called piezoelectric stack or as a magnetostrictive element. These drive mechanisms have the advantage that they execute adjustment paths that are analogous to the voltage application and actually with a higher actuation force when the absolutely produceable path is also relatively small so that with large adjustment paths, large piezoelectric element packets must also be used. The additional advantage of drive mechanisms of this kind is comprised in that they act very quickly so that quick switching events can be executed, which are highly advantageous, particularly in injection technology.

The valve body 42 can now be adjusted by the drive mechanism 59 so that on the one hand, it comes into contact with its first sealing face 46 against the first valve seat 55 and consequently shuts off the connection between the control chamber 36 and the outflow conduit 57. In this instance, the high pressure of the high-pressure fuel reservoir 5 is supplied to the control chamber 36 and due to the resultant force from the pressure acting on the end face 34, of the valve member the injection valve member 21 is held in the closed position. In another switching state of the drive mechanism 59, the valve body 42 comes with the second sealing face 47 of the valve body 42 into contact with the second valve seat 54 and consequently closes off the flow of high-pressure fuel to the control chamber 36 and simultaneously opens the outflow conduit 57. The control chamber 36 is then relieved and the injection valve member 21 can travel into the open position as a result of the high fuel pressure acting on its pressure shoulder 31 and consequently, can execute a fuel injection. If the control chamber 36 fills once more with high fuel pressure, the injection valve member 21 is brought back into the closed position because of the now preponderant force in the closing direction.

Figure 4:
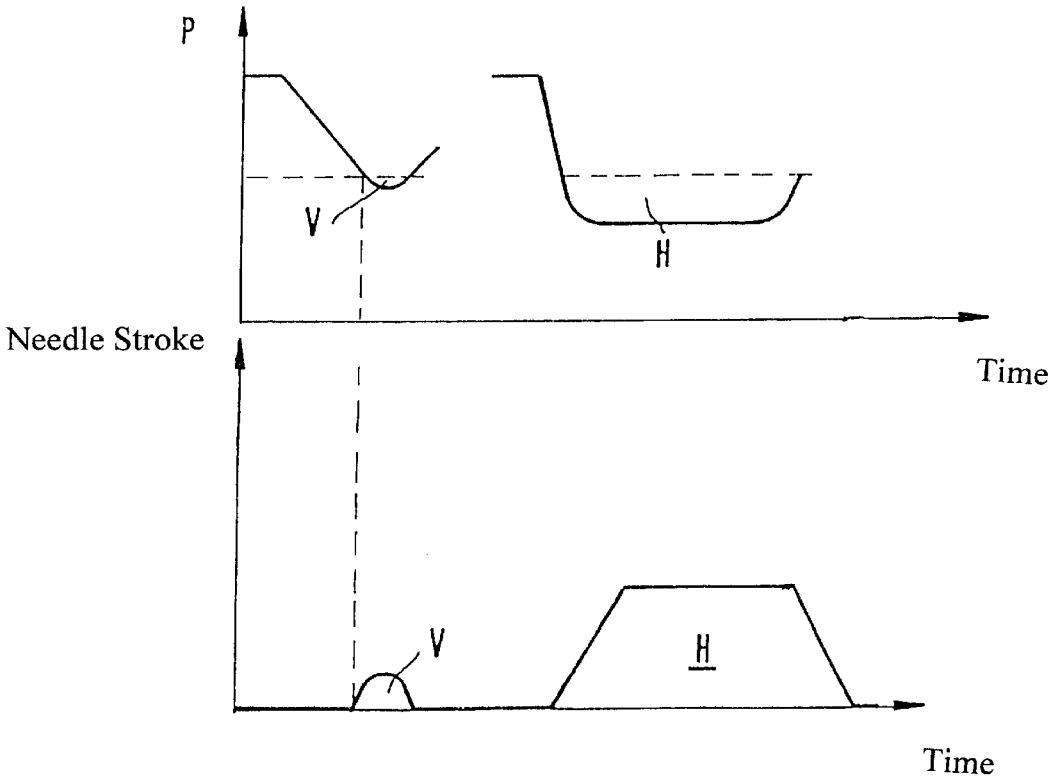
FIG. 4 shows a pressure progression that clarifies the triggering and the effects of the control events of the 3-way valve.

In lieu of the above-depicted positions of the closing body 42, this body can now be brought into an intermediary position by means of corresponding excitation of the piezoelectric elements of the drive mechanism 59 so that an average pressure between the highest pressure level corresponding to the pressure in the high-pressure fuel reservoir and the lowest pressure level corresponding to the relief pressure can be adjusted in the control chamber 36. In accordance with the other forces acting on the injection valve member, this produces the possibility of bringing the injection valve member into an intermediary position via which fuel arrives at injection into the combustion chamber in a throttled fashion. This injection is preferably used for a pre-injection of the kind that is required for noise reduction in engines with externally supplied ignition. At the top in FIG. 4, the pressure progression of the pressure P in the control chamber 36 is depicted over time and beneath it is shown the stroke of the injection valve member, which corresponds in quantity and duration to the respective injection. It is clear that for the main injection H in the solid lines at the top, the control chamber 37 is relieved to a significantly greater degree than in the region of the pre-injection V.

For example, the throttle 58 is provided in the outlet conduit 57 in order to dynamically influence the opening and closing movements of the injection valve member 21. Furthermore, a throttle 60 can likewise be inserted in the inlet conduit 53 and influences the pressure increase in the control chamber, wherein both throttles 58 and 60 are tuned together to the state of the intermediary position of the valve body between the two valve seats and the pressure production in the control chamber 36. These throttles and/or the respective proximity of the closing body 42 to the one or the other of the valve seats 54 or 55 have an influence on the resultant pressure of the control of the pre-injection quantity. In the example shown here, the inlet conduit 53 feeds into the annular chamber 51. In the reverse, the inlet conduit can also be disposed at the location of the outlet conduit 57 of FIG. 3 and the outlet conduit can be provided at the location of the inlet conduit 53 of this FIG. On the one hand, this embodiment has the advantage that in the region of the guidance between the guide bore 50 and the tappet 45, only low fuel pressures prevail so that a leak is prevented here. On the other hand, though, in the closed position of the sealing face 46 disposed on the first valve seat 54, a relatively higher pressure still acts on the remaining area on the valve body, which loads this valve body in opposition to the drive mechanism. This loading, however, can be overcome with the aid of piezoelectric elements which produce powerful forces.

The foregoing relates to a preferred exemplary embodiment of the invention, it being understood that other variants and embodiments thereof are possible within the spirit and scope of the invention, the latter being defined by the appended claims.

We claim:

1. A fuel injection device for internal combustion engines, comprising a high-pressure fuel source (5, 8) that is connected to a fuel injection valve (14), said fuel injection valve has an injection valve member (21) for controlling an injection opening (25) and has a control chamber (36), said control chamber is defined by a movable wall (34) which is at least indirectly connected to the fuel injection valve member (21), and with an inlet conduit (53) through which fuel from a high-pressure source (8) communicates with the control chamber (36), and with an outflow conduit (57) by way of which the control chamber (36) is connected to a relief chamber (6), wherein the above-mentioned connections to and from the control chamber are controlled by way of a valve (40), which has a valve member (43) with a closing body (42) that is disposed so that the closing body moves coaxial to first and second valve seats (54, 55) in a valve chamber (41), the valve chamber continuously communicates with the control chamber (36) by way of a conduit (37) and with a tappet (45) that is moved by an electrically actuated drive mechanism (59), by means of the drive mechanism the closing body (42) is moved between the first and second valve seats (54, 55) and is guided in a guide bore (50) that coaxially adjoins one of the first and second valve seats (54, 55), wherein between the first valve seat (54), the tappet (45, 48) and the guide bore (50), a through flow conduit (51) is embodied in the housing (19) of the valve and is connected to the outflow or inflow conduit and, adjacent to the second valve seat (55), the inflow or outflow conduit continues coaxially, and a throttle (58, 60) that controls the through flow is disposed in at least one of the conduits (53, 57), a piezoelectric element or a magnetostrictive element is provided as the drive mechanism (59) of the tappet (45), of the drive mechanism excitation can be controlled so that the valve body (42) assumes a position in which one of the first and second valve seats (54, 55) is completely opened or completely closed, or assumes an intermediary position in which both of the valve seats (54, 55) are open in a controlled manner and the control chamber (36) experiences a partial relief by means of which the injection valve member (21) is moved into a partially open position.

2. A fuel injection device according to claim 1, in which the tappet is connected to the closing body.

3. A fuel injection device according to claim 1, in which a first throttle (60) is disposed in the inflow conduit (53) and a second throttle (58) is disposed in the outflow conduit (57).

4. A fuel injection device according to claim 1, in which the inflow conduit (53) feeds into a valve chamber (41) on the side of the tappet (45).

* * * * *